United States Patent [19]

Sawada et al.

[11] Patent Number: 4,539,947

[45] Date of Patent: Sep. 10, 1985

[54] RESONATOR FOR INTERNAL COMBUSTION ENGINES

[75] Inventors: Toshiichi Sawada, Kariya; Yasuhiko Fukami, Nishikasugai; Shuzo Kinkori, Okazaki, all of Japan

[73] Assignee: Nippondenso Co., Ltd., Kariya, Japan

[21] Appl. No.: 559,242

[22] Filed: Dec. 8, 1983

[30] Foreign Application Priority Data

| | | | |
|---|---|---|---|
| Dec. 9, 1982 | [JP] | Japan | 57-216336 |
| Dec. 9, 1982 | [JP] | Japan | 57-216338 |
| Dec. 13, 1982 | [JP] | Japan | 57-218822 |

[51] Int. Cl.[3] ..... F02B 27/02; F02M 35/10

[52] U.S. Cl. ..... 123/52 M; 60/312; 181/182

[58] Field of Search ..... 123/52 MB, 52 M, 52 MV, 123/188 A, 188 S; 181/160, 182; 60/312

[56] References Cited

U.S. PATENT DOCUMENTS

| | | | |
|---|---|---|---|
| 418,418 | 12/1889 | Nash | 123/188 A |
| 1,462,654 | 7/1923 | Philip | 123/188 S |
| 1,987,160 | 1/1935 | Saives | 123/188 S |
| 2,720,873 | 10/1955 | Pick | 123/188 S |
| 3,254,484 | 6/1966 | Kopper | 60/312 |
| 4,359,028 | 11/1982 | Fiala | 123/399 |
| 4,422,415 | 12/1983 | Matsuo et al. | 123/52 M |

FOREIGN PATENT DOCUMENTS

| | | | |
|---|---|---|---|
| 1601350 | 11/1970 | Fed. Rep. of Germany | 60/312 |
| 2378183 | 9/1978 | France | 123/52 M |
| 0051909 | 4/1980 | Japan | 123/52 MB |
| 0087821 | 7/1980 | Japan | 123/52 MB |
| 2095328 | 9/1982 | United Kingdom | 123/52 M |

*Primary Examiner*—Craig R. Feinberg
*Assistant Examiner*—David A. Okonsky
*Attorney, Agent, or Firm*—Cushman, Darby & Cushman

[57] ABSTRACT

A resonator for internal combustion engines, having an enclosed chamber of predetermined volumn connected to an intake duct by a tubular connecting member which is composed of an external member and an internal member. The internal member is disposed within the external member and moved by an actuator which is controlled by an electrical signal corresponding to a resonant frequency calculated by a computer in synchronism with engine rotational speeds. The resonator thereby functions to absorb resonant noises from the engines by appropriately changing the length and/or cross-sectional area of the tubular connecting member.

7 Claims, 29 Drawing Figures

RESONATOR FOR INTERNAL COMBUSTION ENGINES

BACKGROUND OF THE INVENTION

The present invention relates to a resonator for internal combustion engines and, more specifically, to a resonator with a variable connecting means to the engine.

The conventional type resonator of FIG. 1 being located in an intake duct, consists of a predetermined closed volume or chamber to which is connected a tubuler member. The resonant frequency of this type resonator is calculated as follows:

$$F_p = c/2\pi \cdot \sqrt{\pi D^2/4V(l + 0.8D)}$$

wherein, D is inside diameter of the tubular member, l is the length of the tubular member and V is the volume of the resonant chamber. It has been observed that in the conventional type resonator, dimensions of each component can not be varied freely. Therefore the resonant frequency is discriminately determined from such dimension so that a reduction of an intake noise is achieved only at a specific resonant frequency, thus satisfactory reduction of the intake noise over a wide range of engine speeds is impossible to achieve.

SUMMARY OF THE INVENTION

Accordingly, it is an object of the present invention to provide a resonator for improving the noise reduction characteristics of internal combustion engines.

Another object of the present invention is to provide a resonator for increasing engine output over a wide range of engine speeds.

Another object of the present invention is to provide a resonator for changing the resonant frequencies in an internal combustion engine by changing length of a tubular connecting member of the resonator.

A further object of the present invention is to provide a resonator capable of controlling the resonant frequencies in internal combustion engines by changing an air-passage area of the tubular connecting member of the resonator.

Yet another object of the invention is to provide a resonator capable of controlling the resonant frequencies in internal combustion engines by changing both length and air-passage area of the tubular connecting member of the resonator.

A still further object of this invention is to provide means for changing resonant frequencies by delivering to an actuator of the resonator an electric signal delivered from a computer corresponding to engine rotational speeds at that time.

An additional object of this invention is to provide means for changing resonant frequencies by delivering to an actuator of the resonator an electric signal delivered from a computer corresponding to open/close movements of an intake valve of the engine.

The foregoing, other objects and advantages of the present invention will become apparent from the following detailed description made in connection with the accompanying drawings.

DETAILED DESCRIPTION OF THE PREFERRED EMBODIMENT

A first preferred embodiment of a resonator of the present invention, for internal combustion engines, is described with reference to the accompanying drawing FIG. 2.

Figure 1:
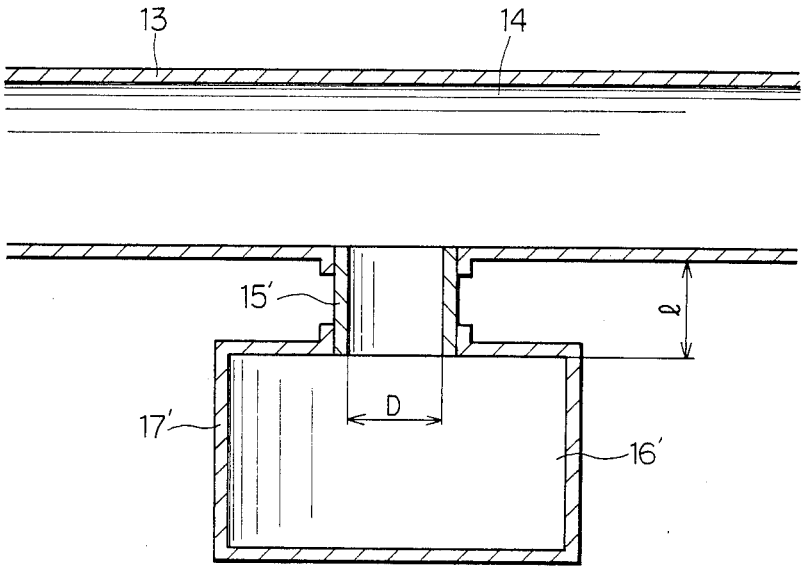
FIG. 1 PRIOR ART
FIG. 1 is a cross-sectional view of the conventional resonator.
Figure 2:
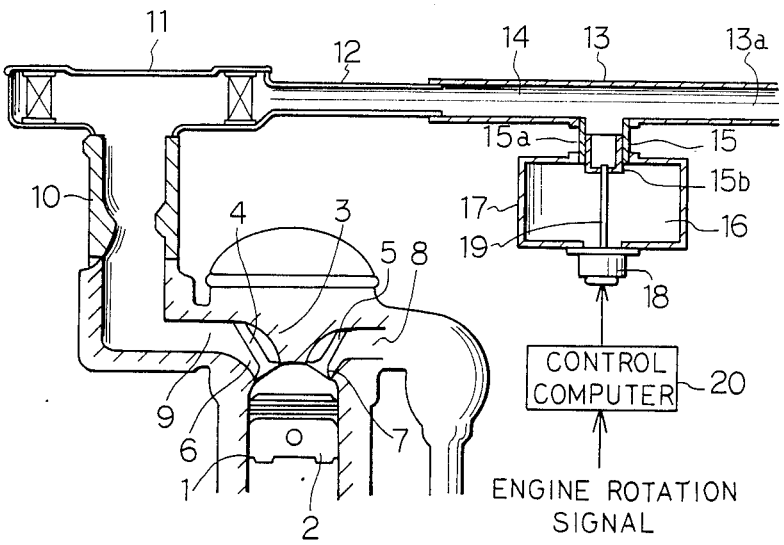
FIGS. 2, 10 and 17 show cross-sectional views of-a first, second and third embodiments of the resonator for internal combustion engines of the present invention.

In FIG. 2, numeral 1 designates a cylinder in which a piston 2 can move smoothly, and the top of which is covered by a cylinder-head 3, and in the cylinder-head 3, an intake inlet 6 and an exhaust inlet 7 are formed, which are opened and shut periodically by an intake valve 4 and an exhaust valve 5 respectively.

The exhaust inlet 7 is connected by way of exhaust passage 8 to an exhaust tube in the end wherein a muffler (not designated) for the purpose of suppressing exhaust gas noise is employed.

On the other hand, the intake inlet 6 through an intake passage 9 and a carburetor 10 (not necessary to diesel engines), is connected to an air-cleaner 11 which purifies the intake air. In the up-stream end of the air-cleaner 11, an intake tube 12 is disposed, at one end of which an intake duct 13 is connected, and the top open area 13*a* of the intake duct 13 opens into the air.

A tubular member 15, being located in the intake tube 12 or the intake duct 13 (located in the intake duct 13 in this preferred embodiment), diverges from it.

One end of the tubular member 15 opening into an intake path 14 of the intake duct 13, the other end of the member 15 opens into a resonant means 16 defining a closed volume of a predetermined size. The tubular member 15 and said resonant means 16 connect to form a resonator 17. The tubular member 15 has a double-tube construction wherein an internal tubular member 15*b*, in effect a throttle valve member, is movable along the inside wall of an external tubular member 15*a*. The external tubular member 15*a* is fixed to the intake duct 13 at one end and to the resonator 17 at the other end. On the other hand, the internal tubular member 15*b* is in the resonant means 16 anchored to a shaft 19 of an actuator 18 fixed to from the opposite side of the tubular member 15. In addition, the intake duct 13 and the internal and external tubular members 15*b*, 15*a* and the resonant means 16 all are made by means of plastic molding. Therefore the aforementioned intake duct 13, the external tubular member 15*a* and the resonator 17 are mounted on by means of adhesives, threads, staking or welding.

A step-motor, for example, is used in order to provide both electrically and easily precise placement control for the internal tubular member 15*b*. A control computer 20, using a rotation signal delivered from a rotation detecting device (not illustrated) for internal combustion engines, calculates resonant frequencies in synchronism with the engine speeds, and such electric signal corresponding to such calculation is applied to the actuator 18. Accordingly the internal tubular member 15*b* fixed on the shaft 19 of the actuator 18 moves upward and downward, along with the inside wall of the external tubular member 15*a*, with an amount corresponding to the electric signal from the computer 20.

Figure 3:
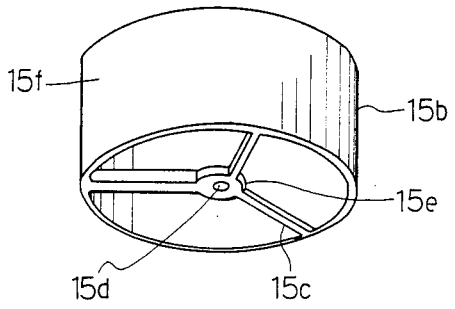
FIG. 3 is a perspective view of an internal tubular member illustrated in FIG. 2.

FIG. 3 shows the internal tubular member 15*b* in detail. Numeral 15*e* is a flange for the purpose of anchoring the shaft 19 of the actuator 18 thereof, and which together with a plurality of beams 15*c* (three beams in FIG. 3) hold a peripheral wall 15*f*. The shaft 19 is installed through the center hole 15*d* of said flange 15*e*. The shaft 19 is crimped or screwed to prevent the same from being moved out of said flange 15*e* thereof. Furthermore, the entire surface of the external wall 15*f* of the internal tubular member 15*b* is in contact with the inside wall of the external tubular member not to create an air leakage path thereof, and also has a predetermined size so that it is capable of moving upward and downward along the contact surface thereof. The way how to change the resonant frequency by the above-mentioned resonator 17 will now be discribed.

Figure 4:
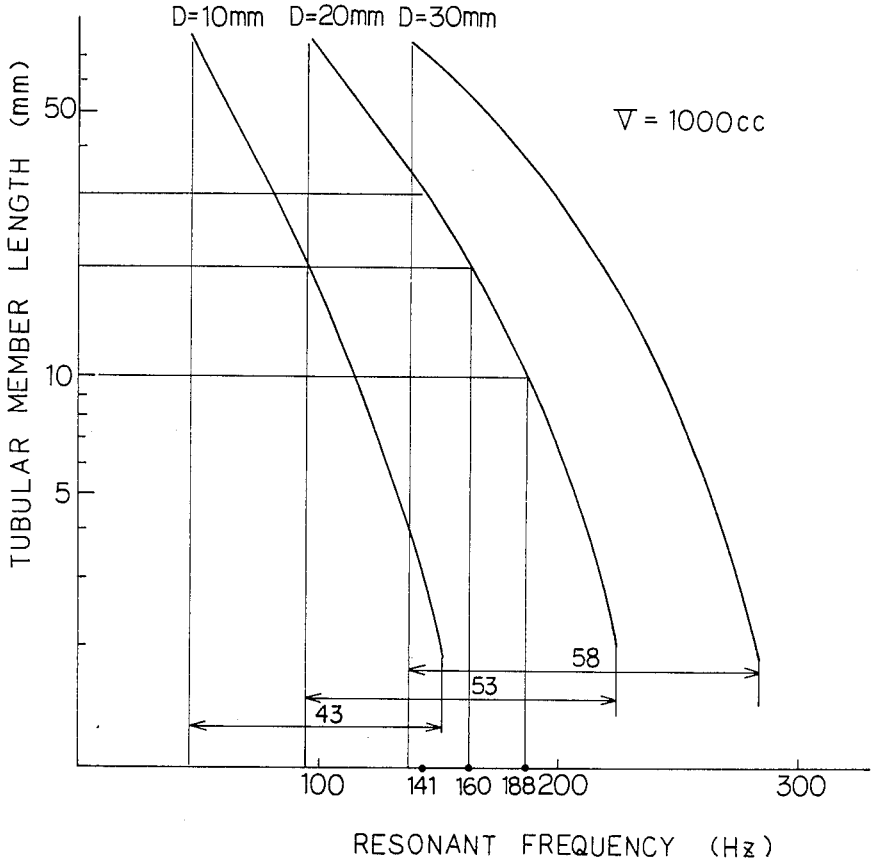
FIG. 4 is a graph showing the relationship between length of a tubular member and resonant frequencies.
Figure 5:
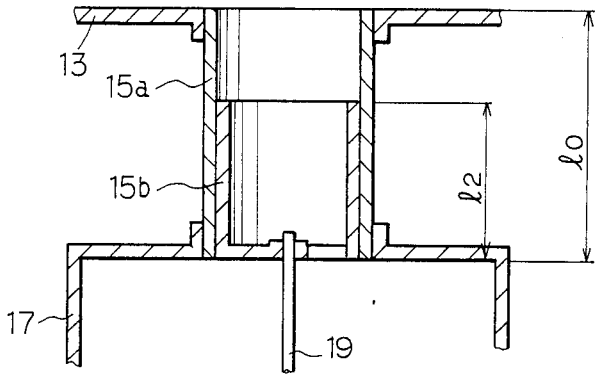
FIGS. 5 and 6 are fragmentary sectional views of the resonator in FIG. 2, showing different positions of the internal tubular member giving different resonant frequencies.
Figure 6:
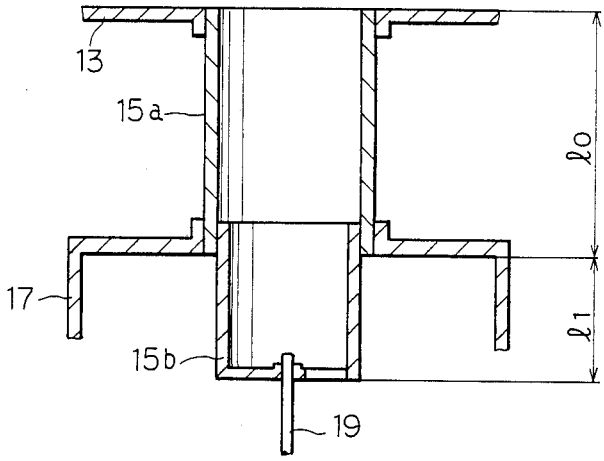

FIG. 4 is a graph showing the relationship between length l of the aforementioned tubular member and resonant frequencies; using the formula (1), for example, in the event that the resonant chamber volume V is 1000 cc and the inside diameter (called I.D. for short hereinafter) of the tubular member is constant. It is well understood from FIG. 4 that in case of length l of the tubular member being 20 mm herein the tubular member I.D. is fixed to 20 mm, the resonant frequency Fp taken on the graph is 160 Hz, shorter length l, i.e. 10 mm reads a higher value of the resonant frequency Fp of about 188 Hz, and conversely longer length l, i.e. 30 mm reads a lower value of 141 Hz of same. Therefore the upper limit resonant frequency Fh is automatically determined when length of the tubular member 15 is the shortest one, i.e. length lo of the external tubular member 15*a* (as described in FIG. 5). The internal tubular member 15*b* that is connected by way of the shaft 19 to the actuator 18 utilizing a step motor has length l2, longer than its moving stroke distance l1 of the actuator 18, and also shorter than length lo of the external tubular member 15*a* as described in FIG. 6.

Consequently, actual length of the tubular member may vary in a range of (l=lo) to (l=lo+l1) by changing the stroke distance l1 of the actuator 18, the lower limit resonant frequency Fl is to be automatically determined by an amount of the external tubular member length lo and the aforementioned actuator moving distance l1, namely, by the tubular member length, l=lo+l1.

Below, more specific resonant frequency range will now be read from FIG. 4. In this instance, for example, if l1 and lo respectively have predetermined lengths 10 mm and 20 mm, the resonator is designed to have a maximum resonant frequency Fk of 160 Hz and minimum resonant frequency Fl of 141 Hz corresponding to (l=lo+l1=30 mm). This means that up-and-down movements of the internal tubular member 15*b* by the actuator 18 will cover continuously the range of the resonant frequencies of 141 Hz to 160 Hz.

In the aforedescribed example, the resonant chamber volume V and the internal tubular member I.D. ($D_2$) respectively are set at 1000 cc and 20 mm, therefore when both are selected at appropriate values, the desired range of variation of the resonant frequency will be easily gained with same moving distance l1.

Figure 7:
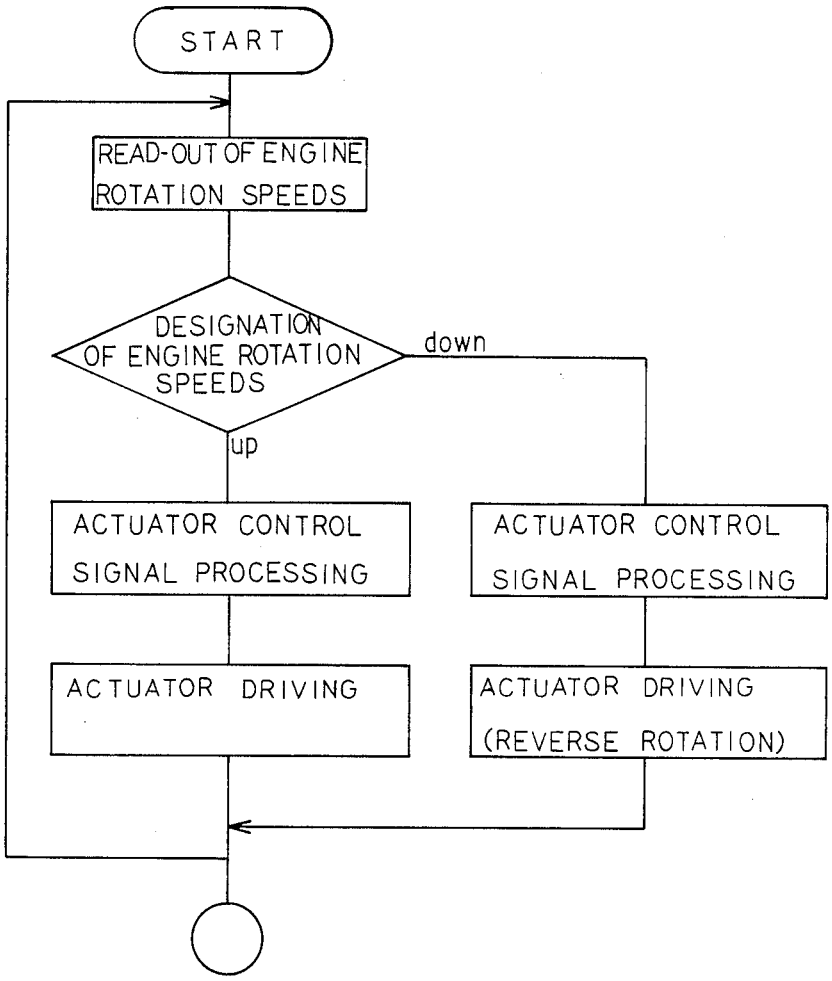
FIG. 7 is a flow-chart showing the operation of a computer of the resonator as illustrated in FIG. 2.
Figure 8:
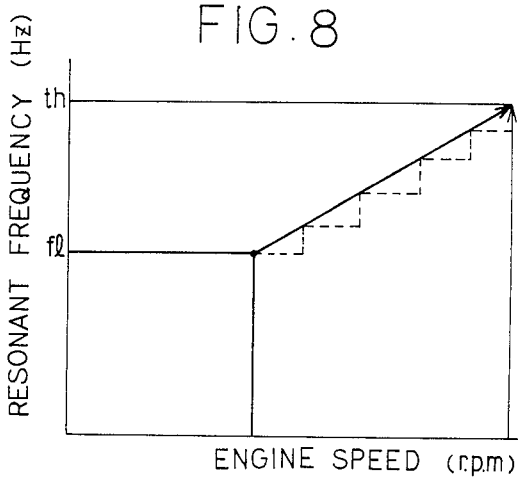
FIG. 8 shows a controlling pattern with respect to engine speeds and resonant frequencies of the first, second and third embodiments of this invention.

It is well understood also that the longer the moving distance the wider the range of variation of the resonant frequency becomes. Below is described an example wherein the resonator 17 acting much the same way as the above will operate in synchronism with rotational speeds of said internal combustion engines. As in FIG. 2, the rotational signal delivered from distributor or crank pulley for example is applied to the control computer 20 which includes a micro-computer, the engine speed is read out, and the predominant frequency ingredient of the intake noises at each engine speed is calculated. In order to absorb the intake noises corresponding to such frequency ingredients, a driving signal is applied to the actuator 18 which will move the internal tubular member 15*b* along with the external member 15*a* by means of the shaft 19, as the results, the resonant frequency will vary. FIG. 7 illustrates the above-described control flow-chart. This controlling method may vary the resonant frequency always in synchronism with the engine rotation speeds by operating the actuator 18 in a right direction and/or a reverse direction. Method of synchronization of engine speeds, as illustrated in FIG. 8, is so presented that it can be freely made by the control computer linearly and continuously or in a step-form in the range of the resonant frequency variation from Fl to Fh.

Figure 9:
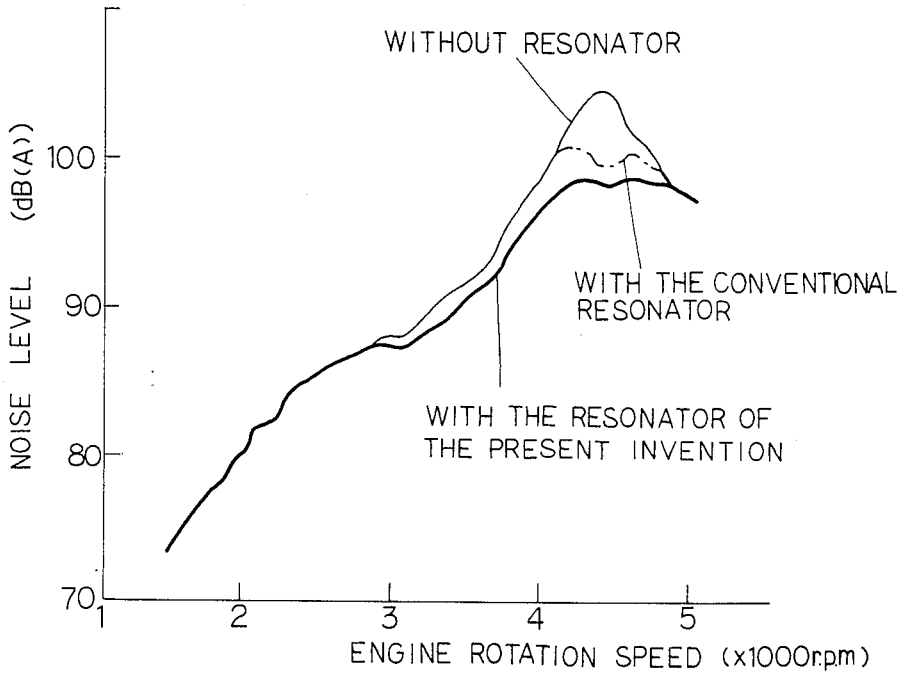
FIG. 9 shows the results of the resonator in FIG. 2, showing an intake noise reduction effects.

As explained in this embodiment of the resonator 17 of the present invention, changing length of the tubular member 15 of the resonator 17 in synchronism with the engine speeds by the actuator 18 varies its resonant frequency, as the results, such frequency range where attenuation effect of the noise is achived can be broader than that of the conventional ones. FIG. 9 shows the intake noise reduction effects in case that the above described resonator 17 is provided in internal combustion engines. In the drawing, the thin line illustrates such intake noise without the resonator 17, and it is clear in the figure that there is a problem of a noise-peak between 4000 r.p.m. and 4800 r.p.m.. This noise-peak is subject to the second component of the engine rotation, that is, 133 Hz to 160 Hz. The resonant frequency thus can be varied in synchronism with engine speeds between 42 30–4800 r.p.m. in its range of about 141 to 160 Hz corresponding to the moving amount of the actuator 18 (10 mm) as described above, and this will improve greater the intake noise as shown by the solid line than that of the engine provided with the conventional type resonator (a dot-dash line) in FIG. 9.

Figure 10:
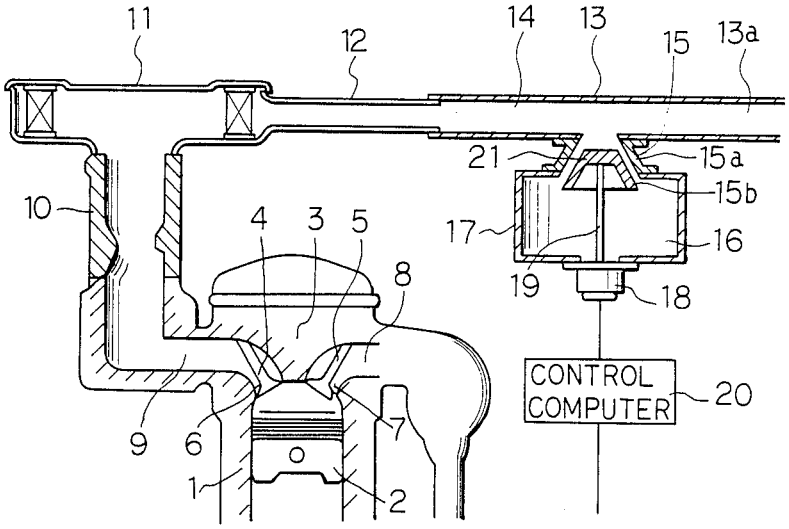

FIG. 10 shows a second preferred embodiment of the invention which has one significant difference from the first embodiment previously described. An external tubular member 15*a* in FIG. 10 has an outwardly tapered portion, from one end of which through the other its open area increases, and inside of its external tubular member 15*a*, a moving member 15*b* (corresponding to the internal tubular member in the first embodiment of the invention) with its outside portion having the same taper angle as the inside wall of said external tubular member 15*a* is secured to a shaft 19 of an actuator 18 as described in the first embodiment. In this arrangement, while the moving member 15*b* moves upwardly by and downwardly by on the center axis of the fixed taper tabular member, by an amount corresponding to an electrical signal from a computer 20, thus a sectional area S of passage 21 surrounded by the outside wall of the moving member 15*b* and the inside wall of said external tubular member 15*a* are variably controlled and at the same time actual length l of said tubular member is also controlled. Next, we obtain the relationship between the actual length l of the tubular member, the sectional area S and the resonant frequencies.

Figure 11:
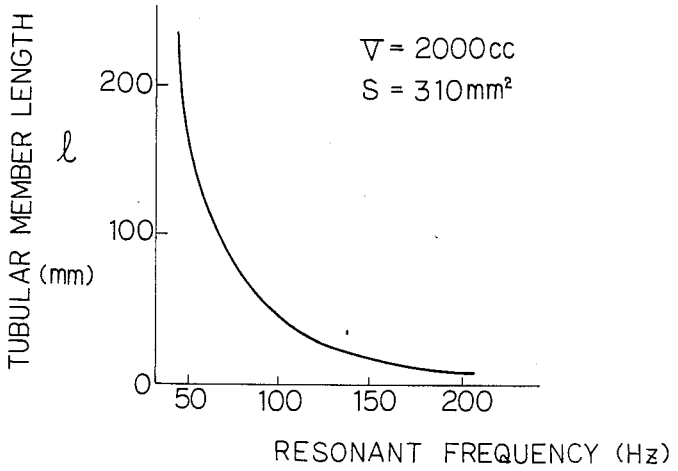
FIG. 11 is a graph showing the relationship between length of a tubular member and resonant frequencies of a resonator as shown in FIG. 10.

FIG. 11 is a graph showing the relationship between the actual length l of the tubular member and the resonant frequencies, using the aforementioned formula (1), for example, in the event that a resonant chamber volume V is 2000 cc and said opening sectional area S is 310 $mm^2$.

Figure 12:
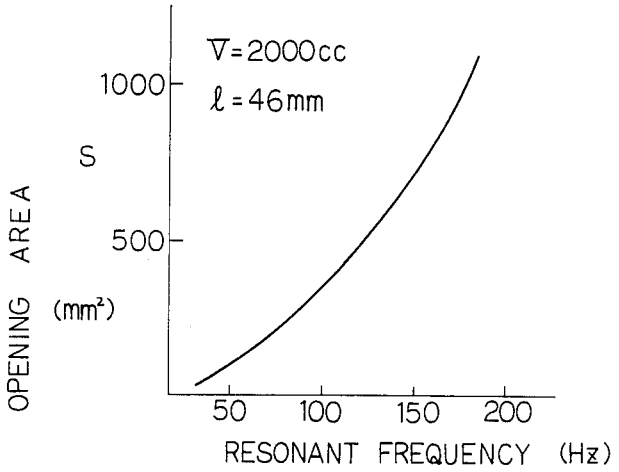
FIG. 12 is a graph showing the relationship between resonant frequencies of the resonator and an opening sectional area of the tubular member.

FIG. 12 then shows a relationship in case that said resonant chamber volume V is 2000 cc and the tubular member's length is 46 mm. The following becomes clear from FIGS. 11 and 12 that either shorter length of the tubular member 15, larger opening sectional area S or both may get higher resonant frequencies. This control method is further explained in more detail using FIGS. 13 and 14.

Figure 13:
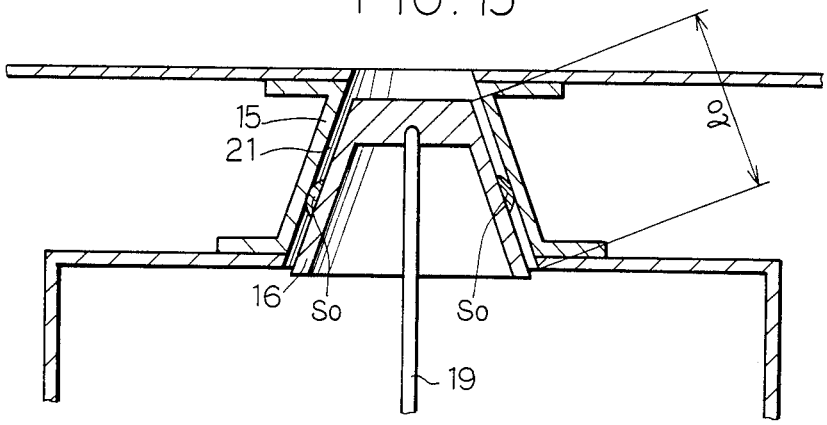
FIGS. 13 and 14 are fragmentary sectional views of the resonator of FIG. 10, showing different positions of an internal tubular member giving different resonant frequencies.
Figure 14:
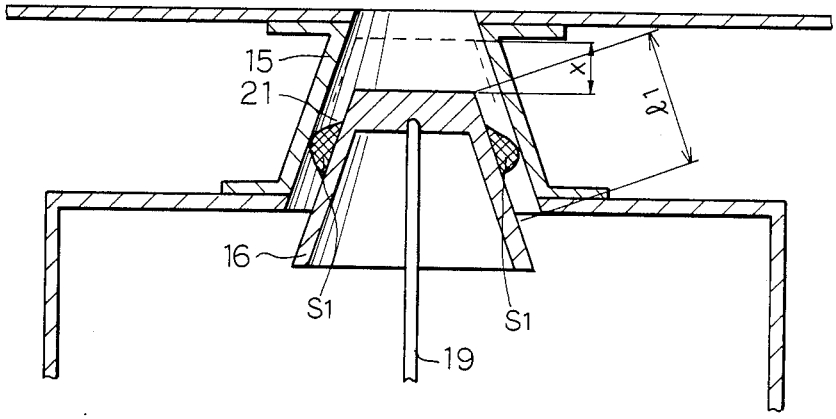

FIG. 13 illustrates predetermined initial positions of the external tubular member 15*a* and the moving member 15*b*, wherein the opening area $S_0$ (passage 21) is to be formed by being surrounded with the insde wall of the external tubular member 15*a* and the outside wall of the moving member 15*b*. Therefore, the resonant frequency Fl in this event is determined as length of overlapping portion of the external tubular member 15*a* and the moving member 15*b*, namely side length lo of the moving member 15*b* is the actual tubular length l, and an average opening area $S_0$ of said passage is the internal tubular member I.D. of the first embodiment of this invention. FIG. 14 illustrates such a case where the moving member is moved xmm from the initial position by the actuator 18, which means that the actual tubular length l is length of such overlapping portion thereof, further the actual inside diameter of the tubular member of the first embodiment corresponds herein to the opening area $S_1$. Therefore, $l_1 < l_0$, $S_1 > S_0$ are presented so that resonant frequency of FIG. 14 may become higher than Fl gained at such initial position of FIG. 13.

In this way the variable range of resonant frequencies may vary from the minimum resonant frequency Fl determined by the initial position as shown in FIG. 13 to the maximum resonant frequency Fh specified by the stroke amount x of the moving member.

Figure 15:
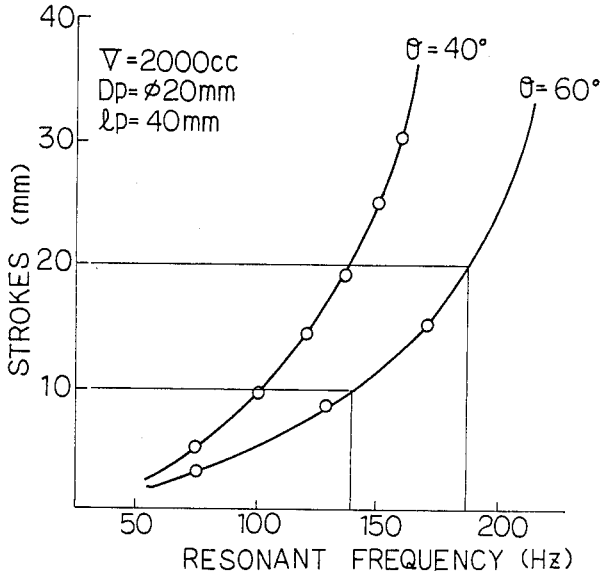
FIG. 15 is a graph showing the relationship between strokes of a moving member of the resonator as shown in FIG. 10 and resonant frequencies.

The resulting curves in FIG. 15 illustrate the relationship between strokes x of the moving member 15*b* and the resonant frequency on such condition that the resonant chamber volume V is 2000 cc, a diameter Dp at one end of the moving member 15*b* (as described in FIG. 16) and length lp of the external tubular member 15*a* are 20 mm (diameter) and 40 mm respectively, on two taper angles $\theta$ of the external tubular member 15*b*, i.e. 40 and 60 degrees. It will be seen by referring to the experimental results that the larger the taper angle $\theta$ is, the wider the range of variation of the resonant frequencies corresponding to the moving strokes x becomes, for instance in case taper angle is a 60 degree angle, the resonant frequency covers a range of about 50 Hz to 180 Hz as the moving member 15*b* moves 20 mm from its initial position. This means that in this second preferred embodiment of the invention, the range of strokes x of the moving member 15*b* can be minimized in order to get same range of variation of the resonant frequencies as being gained in the first embodiment of this invention.

Figure 16:
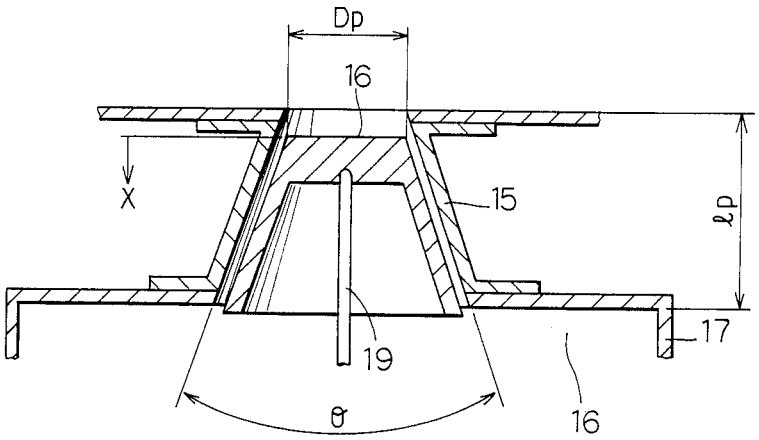
FIG. 16 is a cross-sectional detail view of the resonator of FIG. 10.

In addition, as being clear from the above detailed explanation, though the range of variation of the resonant frequencies is determined by the moving strokes x of the moving member 15*b*, furthermore, if the particulars described in FIG. 16, such as the taper angle $\theta$, the external tubular member's heights lp, the diameter Dp and the resonant chamber volume V are properly selected, the resonant frequencies may be adjustable for a desired range of frequencies with even moving stroke amount. A control flow chart and the relationship between the engine speeds and the resonant frequencies, in case a resonator 17 is used in synchronism with the engine speeds, are as explained in the first preferred embodiment. When the resonator of the second preferred embodiment of this invention is applied for internal combustion engines, the resonant frequencies (as shown in FIG. 15), are properly selected and varied in synchronism with the engine speeds 3000–4800 r.p.m. in its range of about 100 to 160 Hz with the stroke amount x of the actuator 18 at the taper-angle of 60 degrees, this will improve greater the intake noise in the aforementioned rotation range (as shown by the solid line) than that of the engines provided with the conventional type resonator (a dot-dash line) in the FIG. 9.

Figure 17:
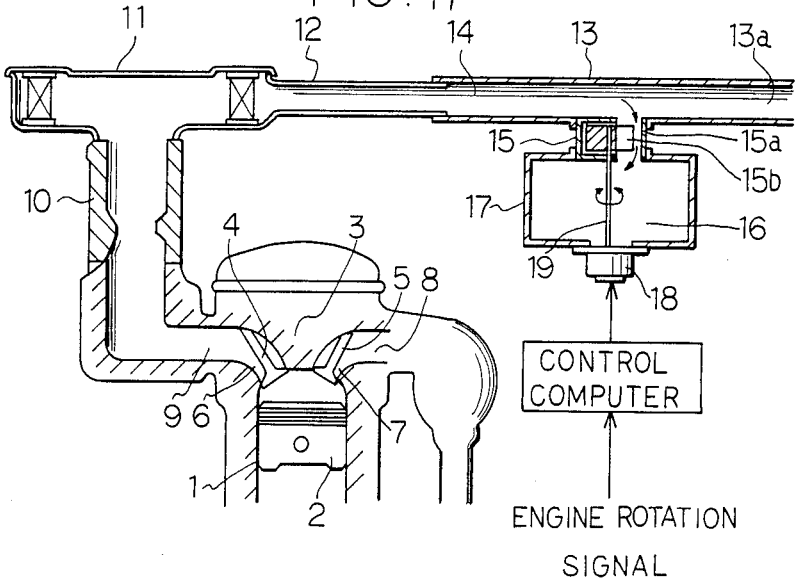
Figure 18:
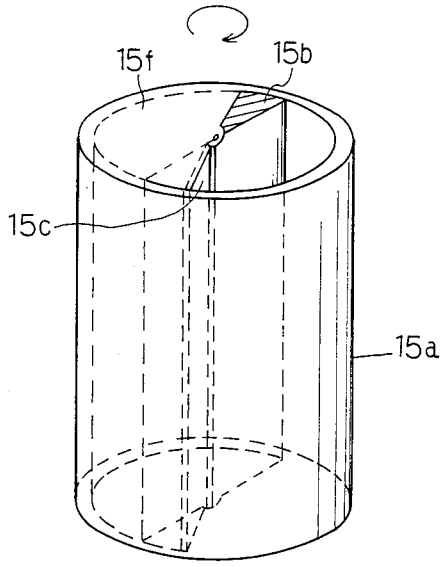
FIG. 18 is a perspective view of a tubular member of a resonator as shown in FIG. 17.
Figure 19:
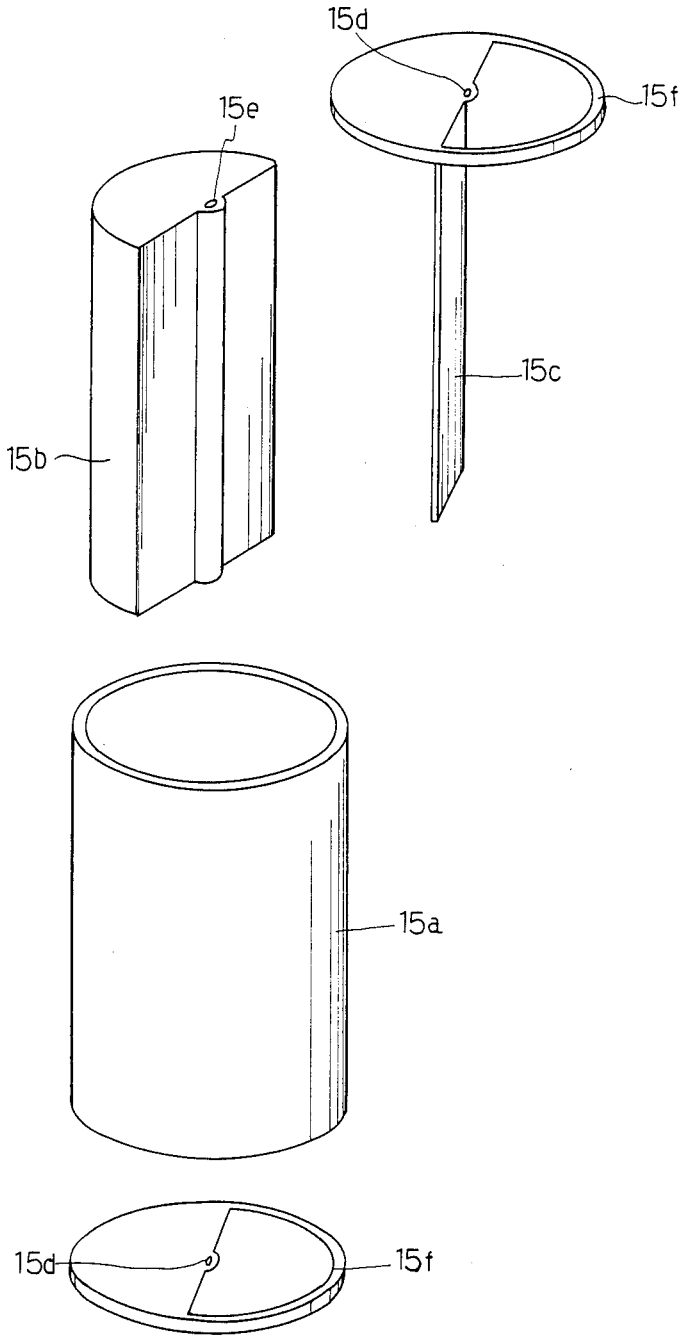
FIG. 19 is an exploded perspective view of the tubular member of FIG. 18.

FIG. 17 shows a third preferred embodiment of the present invention which has a significant difference from embodiments previously described. The tubular member 15, being similar in some respects to those previously described, has a double-tube construction. The details are shown in FIGS. 18 and 19. The tubular member 15 consists of a cap 15*f* having a predetermined open area, an external tubular member 15*a* with said cap 15*f* at each end, a partition plate 15*c* fixed to the cap 15*f*, and a half columnar block 15*b* disposed in the external tubular member 15*a*. A passage in the tubular member 15 is formed between an internal wall of the external tubular member 15*a*, the partition plate 15*c* and the block 15*b*. The external tubular member 15*a* is fixed to an intake duct 13 at one end and to a resonator 17 at the other end. The block 15*b*, being the same as the first and second preferred embodiments of the invention, is fixed to a shaft 19 of an actuator 18, and disposed rotatably in the external member 15*a* for changing said open area in proportion to a rotational angle of the block corresponding to an electrical signal delivered from a computer 20 as explained in the first and second preferred embodiments of the invention. This means that the sectional area of said passage ($\pi D^2/4$) varies, therefore, as the results, it is possible that the resonant frequencies vary. Besides, a hole for the purpose of fixing the shaft 19 of the actuator 18 is provided with the block 15*b* and a guiding hole 15*d* is drilled in the cap 15*f* fixed to the external tubular member 15*a*. The shaft 19 is in the position of the holes 15*e* and 15*d*, and is then fixed there such as being crimped or threaded.

Figure 20:
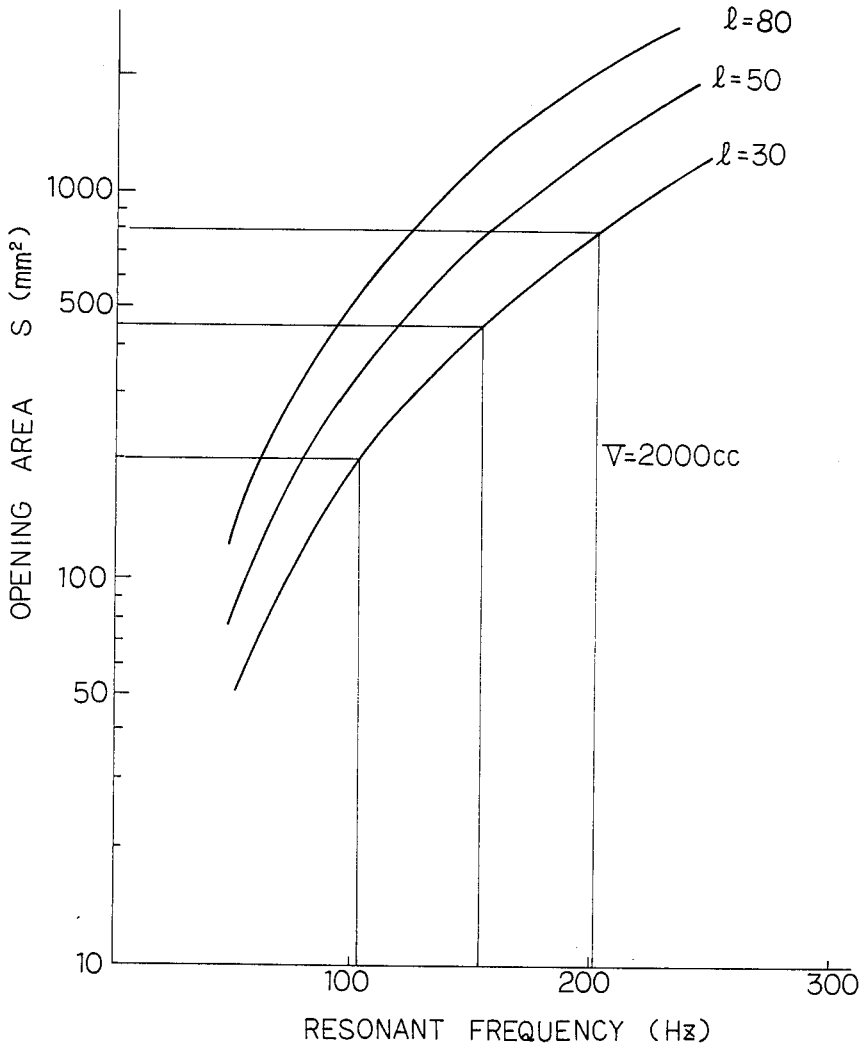
FIG. 20 is a graph showing the relationship between an opening area of the resonator of FIG. 17 and resonant frequencies.

Furthermore, the peripheral external surface of the block 15*b* is in contact with the internal wall of the external tubular member 15*a* eliminating an air-leakage path thereof, and also has a predetermined size but it is capable of rotating itself in the tubular member. The way to change the resonant frequencies will now be described. FIG. 20 is a graph showing the relationship between the opening area S of the aforementioned tubular member and the resonant frequencies, using the formula (1), for example, in the event that the resonant chamber volume V is 2000 cc and the tubular member's length lp is constant. It is well understood from FIG. 20 that in case of the opening area S of the tubular member being 461 $mm^2$ wherein the tubular member's length lp is fixed to 30 mm, the resonant frequency Fp taken on the graph is

Figure 21:
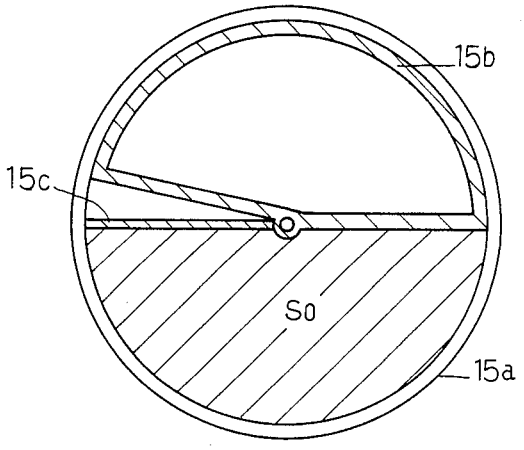
FIGS. 21 and 22 are top views of the resonator of FIG. 17, showing different positions of the block **15*b*** giving different resonant frequencies.
Figure 22:
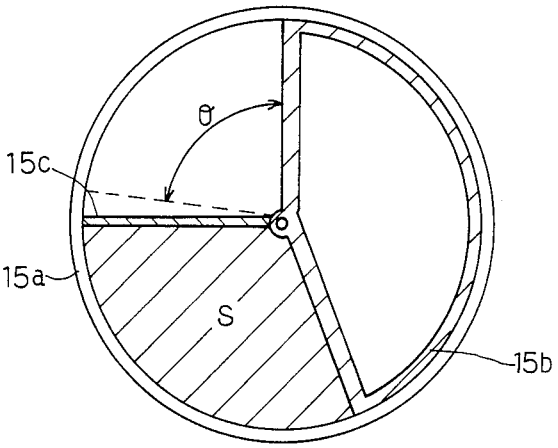

150 Hz, larger opening area S e.g. 820 $mm^2$ reads a higher value of the resonant frequency Fp of about 200 Hz, and conversely smaller opening area S, e.g. 205 $mm^2$ reads a lower value of 100 Hz of same. Therefore, the upper limit resonant frequency Fh to gain is automatically determined when the length of the tubular member 15 is the longest one, this, for example, is achieved when the predetermined opening area $S_0$ of the cap 15*f* illustrated in FIG. 21 is equal to sectional area S of a passage to be formed between the internal wall of the external tubular member 15*a*, the block 15*b* and the partition plate 15*c*. The block 15*b* is connected to the actuator 18, and by rotating, the passage area S formed between said three walls becomes smaller, the lower limit resonant frequency $F_{low}$ is, thus, determined by the-passage area S when the maximum rotational angle $\theta$ of the block from the initial position is presented, as shown in FIG. 22.

Next, more practical calculation of the resonant frequency range will be executed using the experimental results shown in FIG. 20. In this instance, for example, if the tubular member lengths l, a predetermined opening area $S_0$ of the external tubular member and the rotational angle $\theta$ of the block are respectively selected as 300 mm, 525 $mm^2$ and 108 degrees, the minimum sectional area S of said passage will be 205 $mm^2$, and therefore the resonator is designated to have a maximum resonant frequency f up of 160 Hz and a minimum resonant frequency $f_{low}$ of 100 Hz. This means that according to this third preferred embodiment of the invention, by rotating the block 15*b*, the resonsnt frequency varies continuously from 100 Hz to 160 Hz.

Furthermore, in the aforedescribed example, the resonant chamber volume V and the tubular member's length l are calculated respectively as 2000 cc and 30 mm, if and when both are selected at appropriate values respectively, the desired range of variation of the resonant frequencies will be easily gained with same rotational angles $\theta$ of the block. It is well understood that the larger the predetermined opening area $S_0$ of the external tubular member, namely the tubular member I.D., the wider the range of variation of the resonant frequency becomes.

Figure 23:
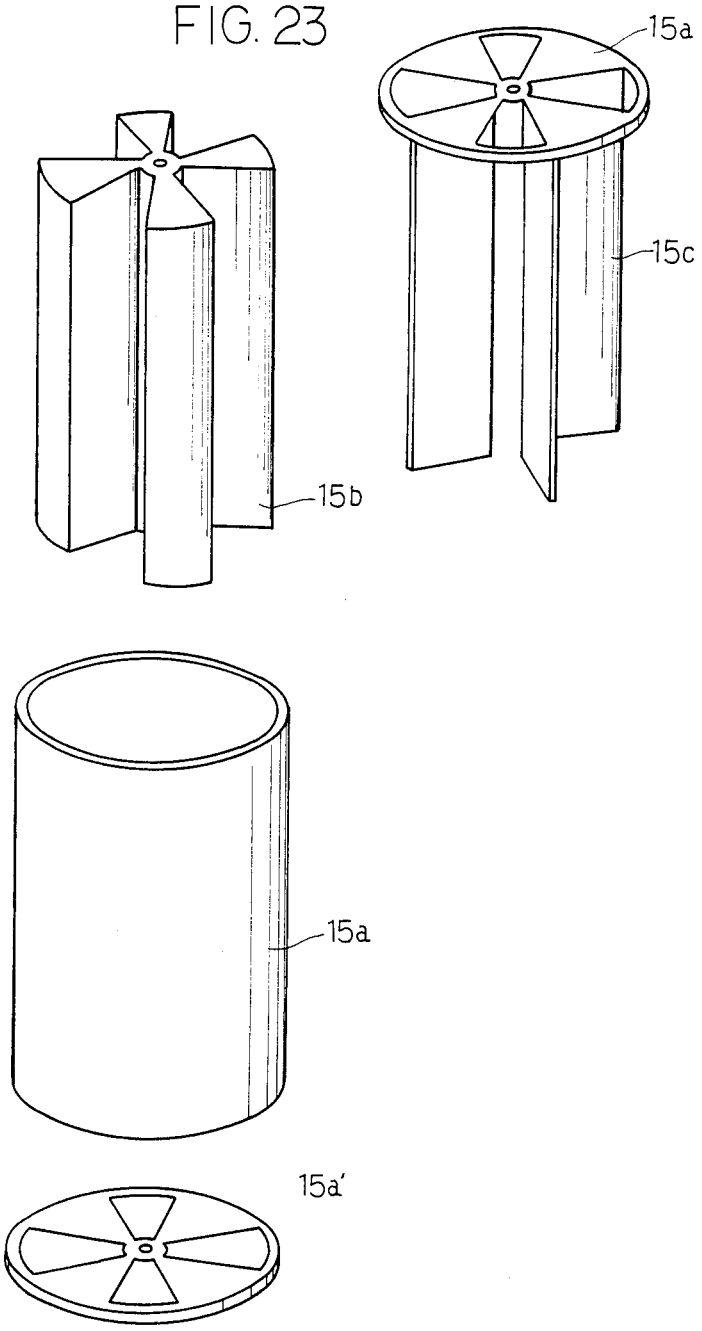
FIG. 23 is an exploded perspective view of an important portion of another embodiment of the resonator as shown in FIG. 17.
Figure 24:
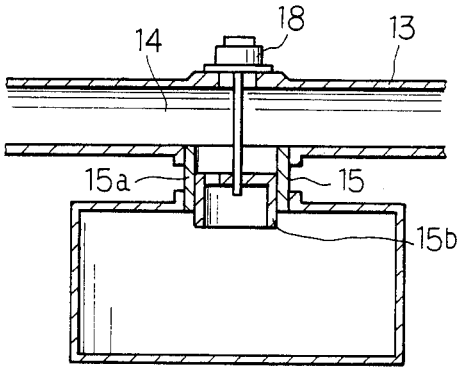
FIGS. 24 and 25 respectively show cross-sectional views of different modifications of the resonator of the first embodiment.
Figure 25:
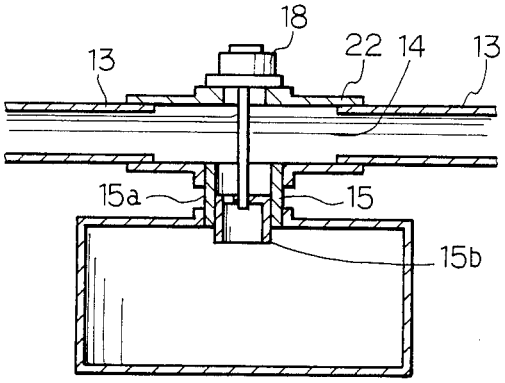
Figure 26:
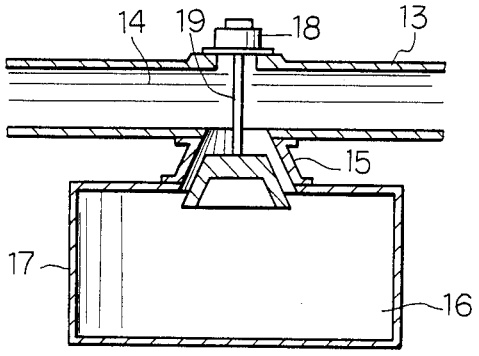
FIGS. 26 and 27 respectively show cross-sectional views of different modifications of the resonator of FIG. 10.
Figure 27:
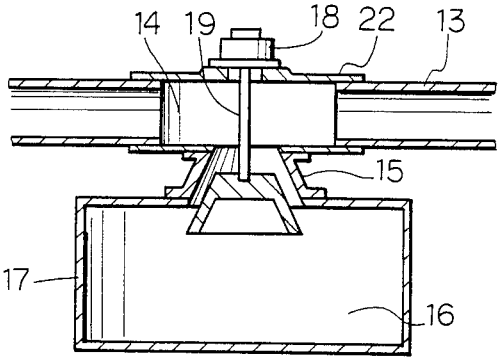
Figure 28:
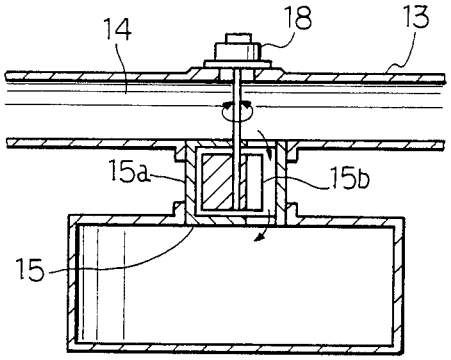
FIGS. 28 and 29 respectively show cross-sectional views of different modifications of the resonator of FIG. 17.
Figure 29:
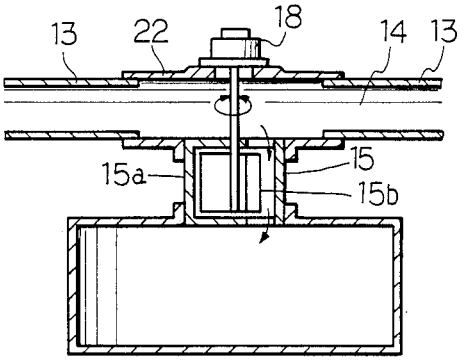

Controlling flow chart and the relationship between the engine speeds and the resonant frequencies in case that the resonator 17 of third preferred embodiment is used in synchronism with the engine speeds, have been described in detail in the first proferred embodiment of the present invention, and omitted herein. In this case, the resonant frequency can be so varied in synchronism with engine speeds 3000–4800 r.p.m. in its range of about 100 to 160 Hz corresponding to the rotational angle $\theta$ of 180° of the actuator 18 as described above that this will reduce greater the intake noise as shown by the solid line than that of the engine provided with the conventional type resonator (a dot-dash line) in FIG. 9. So far there has been explained about the external tubular member 15*a* having only one opening area in the above described embodiment, but the same effect may also be obtained by using the external tubular member 15*a* with a cap 15*a*' having a plurality of opening areas radiating from the center of said cap 15*a*' so that with it being combined with corresponding radial block 15*b* as shown in FIG. 23, the opening sectional area of the tubular member can be varied.

In addition, the resonators in the preferred embodiments may be practiced otherwise, than as described herein, as follows, it is well known fact that if a resonant frequency subject to the intake air-passage conduit is identical to the open/close cycles of the intake valve, a large quantity of mixed gases (fuel and intake air) is introduced into the cylinder, therefore, in light of the conventional teachings, appropriate length of the intake conduit are selected in order to get a desired resonant frequency for certain engine speeds of the internal combustion engines, as the results, the engine output at such engine speeds will thus be increased.

Therefore, if the identical resonant frequency of the intake conduit is varied by changing the resonant frequency of the resonator disposed on the way of the aforementioned intake conduit, and if be further in synchronism with the open and close timing of the intake valve 4, the resonator of this invention will work as means to increase the output over the whole range of the engine speeds.

Obviously many other modifications and variations of the present invention are possible in light of these teachings than the preferred embodiments specifically described herein.

Namely, though in the embodiments described above, the actuator is disposed in the resonant means, one could also achieve these results by placing the actuator from the opposite side of the resonant means, i.e. in the intake duct 13 as illustrated in FIGS. 24 through 29. Furthermore, in consideration of installation thereof, one could so utilize an attachment (22) for fixing the actuator apart from the intake duct 13 that the actuator can be located where desired in the intake duct 13.

In addition, in the above mentioned preferred embodiments, the actuator is used in the intake line as means for reducing the intake noise, and if the same resonator is disposed in the exhaust line, the resonator will turn out to be means for reducing the exhaust noise.

As so far being described above, the resonator of the present invention is so designed to vary the opening sectional area and/or the lengths of the tubular member of the resonator by the actuator in synchronism with the engine speeds, that the resonator of this invention can control the resonant frequency of the intake line, thus assures the wide frequency range of the resonant effectiveness than that of the conventional resonators.

What is claimed is:

1. A resonator for an internal combustion engine having conduit means defining a gas flow path to and from a cylinder having a movable piston, this conduit means including an intake pipe leading to the cylinder and an exhaust pipe leading from the cylinder, said resonator, comprising:

wall means defining a closed volume chamber for absorbing noise generated in said engine;

a tube communicated with said closed volume chamber and being constructed and arranged for communication with at least said intake pipe of one of said pipes intermediate the extent of such pipe, as a branch thereof; and throttle means variably associated with said tube, this throttle means being constructed and arranged to be moved in relation to at least one operational condition of said engine for correspondingly varying the resonant frequency thereof by substantially varying at least one dimensional factor of said resonator in order to absorb engine noise over a broader range of engine speeds than would result from unvarying communication of said tube with said closed volume chamber and respective said pipe.

2. The resonator of claim 1, further including:

an actuator connected with said throttle for moving said throttle means;

a computer constructed and arranged to generate a control signal proportional to rotational speed of said engine;

said actuator being operatively communicated to said computer for activating said throttle means in response to said signal.

3. The resonator of claim 2, wherein:

said throttle means and actuator are constructed and arranged for angular movement of said throttle means in response to said signal.

4. The resonator of claim 3, wherein:

said tube includes at at least one site, a fixed partial cap means which restricts the internal transverse cross-sectional area thereof at such site to no more than such of said transverse cross-sectional area that is not obscured by said partial cap means; and said throttle means comprises a rotor disposed axially adjacent said partial cap means and having a generally sector-shaped body which partially fills the cross sectional area of said tube axially adjacent said partial cap means, such that the effective internal transverse cross-sectional area of said tube may be variably obscured by more than such area is obscured by said partial cap by rotating said rotor out from behind said partial cap by a selected amount.

5. The resonator of claim 2, wherein:

said throttle means and actuator are constructed and arranged for axial movement of said throttle means in response to said signal.

6. The resonator of claim 5, wherein:

said throttle means comprises an inner tube in outer circumferential engagement with an inner circumferential surface of the first-mentioned said tube along a variable extent of mutual telescopic overlap thereof.

7. The resonator of claim 5, wherein:

said tube includes a circumferentially-extending tapering internal surface portion; and said throttle means comprises a plug having a circumferentially tapering external surface portion coaxially juxtaposed with but radially spaced from said tapering portion of said tube so that as said plug is axially moved the degree of openness and the length of the annulus of space defined between said tube section and said plug are simultaneously varied.

* * * * *